US007591284B2

(12) United States Patent
Kort

(10) Patent No.: US 7,591,284 B2
(45) Date of Patent: Sep. 22, 2009

(54) HYDRAULIC ACCUMULATOR

(75) Inventor: Armin Kort, Riegelsberg (DE)

(73) Assignee: Hydac Technology GmbH, Sulzbach/Saar (DE)

( * ) Notice: Subject to any disclaimer, the term of this patent is extended or adjusted under 35 U.S.C. 154(b) by 74 days.

(21) Appl. No.: 11/661,403

(22) PCT Filed: Jun. 8, 2005

(86) PCT No.: PCT/EP2005/006137

§ 371 (c)(1),
(2), (4) Date: Feb. 28, 2007

(87) PCT Pub. No.: WO2006/027034

PCT Pub. Date: Mar. 16, 2006

(65) Prior Publication Data

US 2008/0060711 A1 Mar. 13, 2008

(30) Foreign Application Priority Data

Sep. 8, 2004 (DE) ..... 10 2004 043 352

(51) Int. Cl.
*F15B 1/04* (2006.01)

(52) U.S. Cl. ..... 138/31; 138/30

(58) Field of Classification Search ..... 138/30, 138/31; 60/413
See application file for complete search history.

(56) References Cited

U.S. PATENT DOCUMENTS 2,748,801 A * 6/1956 Mccuistion ..... 138/31
3,150,689 A * 9/1964 Lieberman ..... 138/26
3,364,950 A * 1/1968 Zajdler ..... 138/31
3,370,440 A * 2/1968 Kellie ..... 62/503
3,473,565 A * 10/1969 Blendermann ..... 137/593
3,690,347 A * 9/1972 Zahid ..... 138/30
4,234,016 A * 11/1980 Horino ..... 138/30
4,714,094 A * 12/1987 Tovagliaro ..... 138/31

(Continued)

FOREIGN PATENT DOCUMENTS

DE 41 15 342 11/1992

(Continued)

OTHER PUBLICATIONS

Verband Der Technischen Überwachungs-Vereine e.V.: AD-Merkblätter. Stand Mai 1998. Taschenbuch-Ausgabe 1998.

*Primary Examiner*—James F Hook
(74) *Attorney, Agent, or Firm*—Roylance, Abrams, Berdo & Goodman, L.L.P.

(57) ABSTRACT

A hydraulic accumulator, especially a piston accumulator includes an accumulator housing (10) and a separating piston that can be longitudinally displaced in the accumulator housing (10) and divides two working chambers (12) inside the accumulator housing (10). The housing is sealed on each end by one cover part (16). At least one cover part is fixed, on one side (32) by a free longitudinal edge (34) of the accumulator housing (10). The edge is arranged against the cover part (16). By connecting the free longitudinal edge (34) of the accumulator housing (10) to the associated cover part (16) by a peripheral weld seam (46) for sealing at least one working chamber (12) from the environment in a gas-tight and/or fluid-tight manner, a reliable sealing is obtained by the weld seam (46). The weld seam also connects the free longitudinal edge (34) of the accumulator housing (10) to the associated cover part (16).

9 Claims, 1 Drawing Sheet

U.S. PATENT DOCUMENTS

| | | | | |
|---|---|---|---|---|
| 5,311,910 | A * | 5/1994 | Hasegawa et al. | 138/31 |
| 6,418,969 | B1 * | 7/2002 | Bertagna | 138/30 |
| 6,460,571 | B1 * | 10/2002 | Rajabi et al. | 138/31 |
| 6,712,096 | B1 * | 3/2004 | Tischler | 138/30 |
| 7,325,571 | B2 * | 2/2008 | Shimbori et al. | 138/30 |
| 2007/0102052 | A1 * | 5/2007 | Yoshihara et al. | 138/30 |

FOREIGN PATENT DOCUMENTS

| | | |
|---|---|---|
| DE | 103 03 988 | 8/2004 |
| JP | 03 092 601 | 4/1991 |
| JP | 2003-205373 | 7/2003 |
| JP | 2003-336601 | 11/2003 |

* cited by examiner

HYDRAULIC ACCUMULATOR

FIELD OF THE INVENTION

The present invention relates to a hydraulic accumulator, in particular a piston accumulator, having an accumulator housing, and a separator piston movable in the longitudinal direction in the accumulator housing. The piston separates two working chambers from one another within the accumulator housing. The housing is closed on each end side by a cover part, at least one cover part on its one side being fixed by one free longitudinal edge of the accumulator housing, which edge is advanced onto this cover part for this purpose.

BACKGROUND OF THE INVENTION

Piston accumulators are in the broadest sense hydraulic accumulators used among other things to hold certain volumes of a pressurized liquid (hydraulic medium) of a hydraulic system and to return it if necessary to the system. Since the hydraulic medium is under pressure, hydraulic accumulators are treated like pressure vessels and must be designed for the maximum operating overpressure with consideration of the acceptance standards of diverse delivery countries. In most hydraulic systems at present hydropneumatic (gas-pressurized) accumulators with separating elements are used. For piston accumulators, the separating element is a piston within the piston accumulator housing, and separates a liquid chamber as the working chamber from the gas chamber as another working chamber. The working gas is generally nitrogen. The gas-tight piston largely permits decoupling from the gas chamber to the liquid chamber.

The liquid part is connected to the hydraulic circuit of the system so that when the pressure rises, the piston accumulator holds the hydraulic medium and the gas is compressed. When the pressure drops, the compressed gas expands and displaces the stored pressurized liquid back into the hydraulic circuit of the system. One advantage of a piston accumulator is that it can "work" in any position. A vertical configuration with the gas side up is preferred so that settling of dirt particles from the liquid on the seals of the piston part is avoided.

The important components of a piston accumulator are accordingly an external cylinder pipe as the accumulator housing, the piston as the separating element with its sealing system and the end-side sealing covers as cover parts containing a liquid port and a gas port, respectively. Generally the accumulator housing has two functions, first, storing the internal pressure, and second, guiding the piston within the accumulator housing. The cover parts close off the interior of the accumulator housing relative to the exterior on the end side are provided with an external thread on the outer peripheral side which can be screwed into a corresponding internal thread along the free longitudinal edge of the accumulator housing over a definable distance. Producing this threaded connection is time-consuming, making the production costs for a piston accumulator accordingly higher. Furthermore, safety measures must be taken to lock the added cover part in its position in the accumulator housing.

DE 103 03 988 A1 (corresponding to U.S. Patent Application Publication No. US 2006/0016074 A1) discloses avoiding the otherwise conventional threaded connections, and ensuring a reliable and secure connection of the cover part in the housing of the piston accumulator. For this purpose, in the disclosed solution on one side of the cover part it is fixed over the free longitudinal edge of the accumulator housing, which free longitudinal edge for this purpose undergoes a feed motion onto the cover part during the production process of the hydraulic accumulator. While avoiding the otherwise conventional screw connection solution for the respective cover part, a type of clamp seat on the respective free end of the accumulator housing is achieved. The cover part is clamped fast at least over the free longitudinal edge of the accumulator housing after its feed motion during production onto the cover part. In this connection, it is sufficient if part of the free longitudinal edge implements this clamping seat.

Although for the above-described hydraulic accumulator solution the cover part is provided with sealing means, especially in the form of gaskets, it cannot be precluded that especially at high pressures in the working chambers and/or for correspondingly long service lives the medium stored in the working chamber unintentionally travels to the exterior. Especially when using a working gas for the working chamber of the accumulator, it must be expected that portions of gas will travel to the exterior via the sealing means of the cover part. Viewed over the long-term, this gas escape degrades the operating reliability of the hydraulic accumulator. The degrading of the operating reliability occurs especially when the hydraulic accumulator with its sealing means is exposed to major temperature fluctuations of the magnitude of −40° C. to 130° C. This range of values causes the elastomer material of the sealing means generally to yield.

In the known hydraulic accumulator solutions, generally the possibility exists of adding working gas to the pertinent working chamber of the accumulator. This adding of has, however, is accompanied by the corresponding maintenance cost which is especially undesirable if the designed hydraulic accumulators are to be used in the form of a disposable solution on site within the hydraulic system only for a predetermined time. For the correspondingly designed hydraulic accumulator and depending on its application, it can be more economical to replace it terms of a disposable solution by a new one rather than maintain it on site.

SUMMARY OF THE INVENTION

An object of the present invention is to provide improved hydraulic accumulators that are largely media-tight on their gas sides so that they can also be designed as so-called disposables.

This object is basically achieved by a hydraulic accumulator with a gas-tight and/or fluid-tight sealing of at least one working chamber relative to the exterior. The associatable, advanced free longitudinal edge of the accumulator housing is connected to the respective cover part by a peripheral weld. Reliable sealing is obtained by the weld. Moreover, the weld provides a reliable connection between the free longitudinal edge and the respective cover part so that failure is reliably prevented, even when correspondingly high pressure peaks are experienced. On the whole, the connection stability for the accumulator solution can be increased by the peripheral weld.

The placement of the cover part in the accumulator housing, the preparation of a clamping seat between the free longitudinal end of the accumulator housing and the cover part, and the formation of the peripheral weld in the described region can be easily and economically accomplished. The described solution can then be implemented as a disposable concept without having to maintain these cheap accumulator solutions, especially not to refill them on the gas side with the working gas, but to dispose of them in case of maintenance or failure and replace them by a new cheap accumulator.

In one preferred embodiment of the hydraulic accumulator of the present invention, at least one of the two cover parts is provided on its one side with a conically extending fixing bevel against which the free longitudinal edge of the accumulator housing is advanced. Preferably, between the end of the free longitudinal edge of the accumulator housing and the fixing bevel of the cover part, a preferably V-shaped fillet groove is formed which holds the weld. This fillet groove dictates a guide path for the peripheral weld to be formed, and facilitates the weld production process accordingly.

In another preferred embodiment, V-shaped fillet groove is not provided with a welding filler. For example, with an electron beam welding process or other welding process suitable for this purpose, the facing edges, especially of the free longitudinal edge of the accumulator housing in addition to adjacent parts of the cover part, are welded on. These welded-on material parts then are able to fill the fillet groove accordingly. Generally, projection of the weld beyond the fillet groove should not then be expected. Depending on the materials used, welding on only the free longitudinal edge of the accumulator housing can be performed, leaving the material of the cover part essentially untouched.

In another especially preferred embodiment of the hydraulic accumulator of the present invention, the respective cover part which seals the working chamber with the working gas in the accumulator housing has a through opening at least for introducing the working gas. The trough opening can be sealed gas-tight by a terminating device. This terminating device can include a plug driven into the through opening. This terminating device leads to an especially economical solution. Alternatively, the terminating device can be formed from a detachable sealing cover allowing refilling processes for the hydraulic accumulator, especially on its side with the working gas. Regardless, hydraulic accumulators can be designed to be disposable at the site of their production or at central maintenance sites for re-use, and to refit them if failed parts can be replaced by new ones.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure and which are schematic and not to scale.

DETAILED DESCRIPTION OF THE INVENTION

Figure 1:
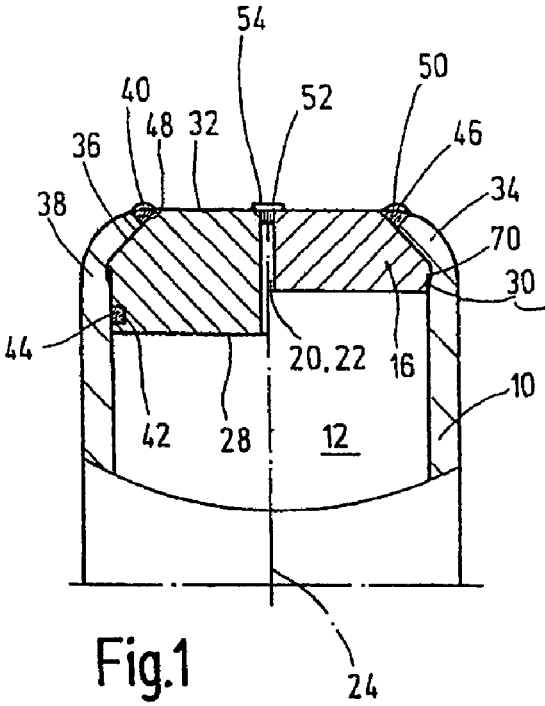
FIG. 1 is a partial, side elevational view in section of the top part of a piston accumulator according to a first exemplary embodiment of the present invention.

The piston accumulator 10 shown in FIG. 1 has an accumulator housing 10 formed as an outer cylinder pipe. The separating element is a piston (not detailed) with its sealing system on the outer peripheral side inserted into and movable longitudinally in housing 10. These piston accumulators with pistons as the separating element are known in a host of designs, and are described for example in the state of the art in DE 103 03 988 A1. The piston within the accumulator housing 10 separates two working chambers 12, 14 (FIG. 4) from one another, one or a first working chamber 12 being used to hold the working gas, especially in the form of nitrogen, and the other, second working chamber 14 forming the so-called liquid chamber for the piston accumulator. Depending on the operating situation of the accumulator, the movement positions of the piston and the volumetric portions of gas and fluid in the working chambers 12 and 14 vary.

On each front end of the accumulator housing 10, there is one cover part 16, 18. First cover part 16 has a gas port 20 in the form of a through opening 22 extending along the longitudinal axis 24 of the hydraulic accumulator and penetrating the first cover part 16, and is the upper cover part, as viewed in FIGS. 1 and 4. The second cover part 16 has a liquid port 26 also extending coaxially to the longitudinal axis 24 for connecting the piston accumulator to a total hydraulic system. This gas port 20 in the form of a through opening 22 is used in turn to fill the accumulator with the working gas. The embodiment shown in FIG. 1 fundamentally relates to a piston accumulator solution which, when the working gas is lost, is generally not refilled. The embodiment shown in FIG. 4 relates to an accumulator which can be refilled with working gas.

Figure 4:
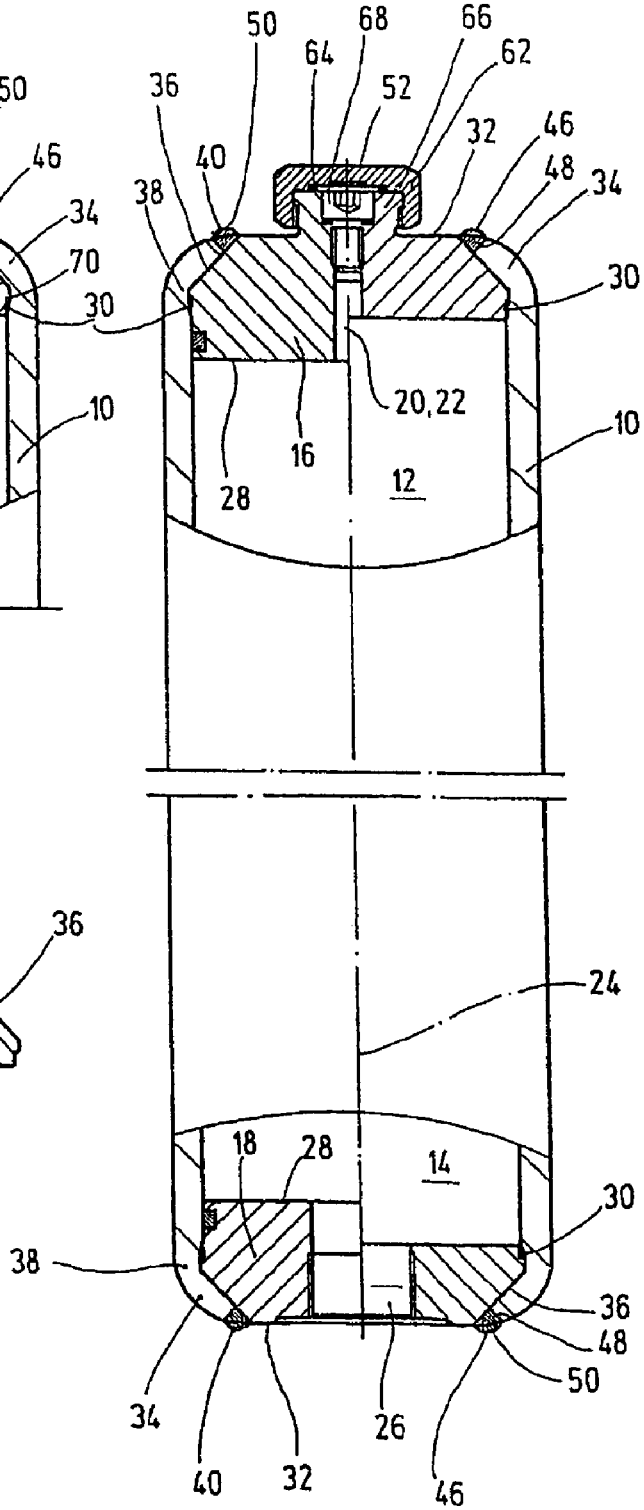
FIG. 4 is a side elevational view partially in section of the top and bottom part of a piston accumulator according to a second embodiment of the present invention, with an altered cover part, in addition to the attached closing cover.

To refit the hydraulic accumulator shown in FIG. 1 or 4, the cover parts 16 and 18, with their sides 28 facing the inside are inserted into the accumulator housing against stops 30 in the form of offset, obliquely extending annular surfaces within the accumulator housing 10. The outer side 32 of each cover part 16, 18 conversely is fixed via the free longitudinal edge 34 of the accumulator housing 10. For this purpose, each longitudinal edge 34 undergoes a feed motion onto the respective cover part 16, 18, as described below and in DE 103 03 988 A1.

For feed of each longitudinal edge 34 of the accumulator housing 10, a shaping tool (not detailed) is used. The shaping tool is provided with a corresponding feed bevel which places or forces the longitudinal edge 34 on the respective cover part 16, 18 such that it is fixed as a clamp seat in the accumulator housing 10 between the respective stop 30 and longitudinal edge 34. To prepare this clamp seat, one respective outer side 32 of the respective cover part 16, 18 is provided with a fixing bevel 36 tilted and tapering to the outside conically towards the longitudinal axis 24 of the accumulator housing 10. The tilt or angle of this fixing bevel 36 corresponds generally to the feed bevel of the forming tool. Other tilts or bevels are also useable.

To achieve better deflection of the respective free longitudinal edge 34 around an articulation 38, this longitudinal edge 34 has a reduced in wall thickness relative to the other wall parts of the accumulator housing 10 forming a main body portion between the free longitudinal edges. The transition site or articulation 38 between the different wall thicknesses forms the stop 30 for the respective cover part 16, 18. The longitudinal edge 34 on its side facing the respective cover part 16, 18 and oriented to the exterior can be provided with an insertion bevel (not shown) extending especially conically to facilitate insertion of the respective cover part 16, 18 into the interior of the accumulator housing 10.

In order not to endanger the secure position of the respective cover part 16, 18 in the accumulator housing 10, and in order to prevent damaging application of forces, the end 40 of the respective free longitudinal edge 34 is guided such that it ends with its outermost exterior end essentially in one plane with the exterior 32 of the cover part 16, 18 extending transversely to the longitudinal axis 24 of the hydraulic accumulator. The indicated forming processes for the respective free longitudinal edge 34 can however proceed cold, as well as in a hot forming process. Conversely the material for the accumulator housing 10 can have correspondingly good workability, for example in the form of a conventional steel material.

To apply the respective clamping forces optimally to the associatable cover part 16, 18, and to ensure good support in the accumulator housing 10, on the edge side for the cover parts 16, 18, the height of the respective cover part 16, 18 is matched to the conditions of use dictated by accumulator operation. Viewed in the direction of FIGS. 1, 2, and 4, in one embodiment the height of the respective left half of the cover part 16, 18 is such that it is at least twice as great as the length of the longitudinal edge 34 between its free end 40 and the deflection site or articulation 38. As shown in the respective right half of each figure, the height of the cover part 16, 18 can be reduced. This reduction applies especially when no engagement groove 42 for engaging a peripheral sealing means in the form of at least one gasket 44 is provided. When short service lives of the accumulator or low pressures are involved, the sealing means in the form of a gasket 44 located on the peripheral side in the respective cover part 16, 18 is not absolutely necessary. If the accumulator housing is made correspondingly large in diameter, the height of the cover part 16, 18 can be reduced accordingly relative to the length of the longitudinal edge 34.

In all cases, a gas-tight and/or fluid-tight sealing of at least one working chamber 12, 14 is provided relative to the exterior. The respective advanced free longitudinal edge 34 of the accumulator housing 10 is connected to the respective cover part 16, 18 by a peripheral weld 46. For positioning of the indicated weld 46, a V-shaped fillet groove 58 is provided that between the end 40 of the free longitudinal edge 34 of the accumulator housing 10 and the fixing bevel 36 of the cover part 16, 18. The weld 46 fills the fillet groove 48 with a projection, which viewed in cross section forms a convexly extending top 50 projecting over the top 32 of the respective cover part 16, 18 and the top of the free end 40 of the longitudinal edge 34. The top 50 of the weld 46 protects beyond the respective end regions of the accumulator housing 10 and cover part 16, 19, and visually enables checking to ensure a complete hermetic seal for a cleanly configured weld 46 in the fillet groove 48. In another embodiment of the hydraulic accumulator of the present invention (not detailed), the weld 46 need not protrude over or beyond the groove 48 with a projection, but can end flush vertically with the top 32 of the cover part or can even be set back to the inside toward the accumulator housing 10. A weld filling material can be placed in the V-shaped fillet groove 58. Via a suitable welding process, such as an electron beam welding process, filling material can also melt-on the free end of the longitudinal edge 34 of the accumulator housing 10 to form the weld 46 via the melt addition of this material portion in the fillet groove 48. Depending on the material selection, the respective cover part 16, 18 with its material portions can also contribute to formation of the weld.

With respect to the high volatility of the working gas in the working chamber 12, this hermetic cover seal acquires special importance, relative to the gas side of the hydraulic accumulator. For the purpose of an economical solution shown in FIG. 4, on both sides of the accumulator housing 10, the feed bevels over the longitudinal edge 34 are prepared at the same time by a shaping tool (not detailed). Since an especially gas-tight configuration in the region of the working chamber 12 is important, the fluid side of the accumulator with the working chamber 14 could have a different cover solution. Besides the additional sealing via the gasket 44, simplified installation for the respective cover part 16, 18 is allowed since the gasket 44, due to its elastic expansion, is able to keep the respective cover part on the inner periphery of the accumulator housing 10 in its installation position. In other configurations of the hydraulic accumulator, the sealing means in the form of a gasket 44 can be omitted, with sealing solely effected by the weld 46. The gasket 44 can also perform the important sealing function, with the weld 46 serving as a holding means ensuring at high pressures that the free longitudinal edge 36 is not lifted off the respective cover part 16, 18.

The cover part 16 sealing the working chamber with the working gas in the accumulator housing 10 is provided with a through opening 22 which can be sealed essentially gas-tight by a terminating means or terminator 52. As shown in FIG. 4, on the opposing side of the accumulator housing 10, the through opening 22 into the cover part 18 is a corresponding fluid passage site for connection of the accumulator to a conventional hydraulic system (not shown). In the embodiment shown in FIG. 1, the terminating means 52 includes a plug 54 shown enlarged in FIG. 3. The plug 54 is preferably formed of a ductile material, and in this way can be driven into the through opening 22 of the cover part 16 via a driving device (not shown). As a result of the completed deformation, the plug 54 remains adherent or fixed in the passage opening 22, even if a corresponding high gas pressure is prevailing in the working chamber 12. Preferably, the plug 54 be joined to the cover part 16 via a welding process, for example, a fiction welding process. For this purpose, which is not detailed, nitrogen filling of the working chamber 12 by a detachable means or connection is induced onto the top of the hydraulic accumulator, and sealed with the accumulator. The fixed connection is then produced via a friction welding means within the detachable means.

Figure 3:
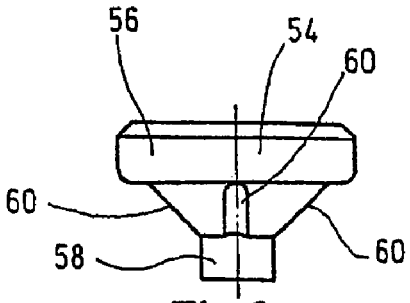
FIG. 3 is an enlarged, side elevational view of the plug shown in FIGS. 1 and 2.

As seen in FIG. 3, the plug 54 has a stop head 56 larger in diameter than the cylindrical insertion part 58 projecting downward for engaging the through opening 22. Between the stop head 56 and the insertion part 58 are conically tapering, bridge-like groove surfaces 60. Each groove surface 60 partially widens on the bridge used for improved insertion into the through opening 22 and ensuring good adhesion to the respective interior wall of the through opening 22 so that unintentional disengagement, for example due to the gas pressure in the working chamber 12, is precluded. Preferably, gas feed is ensured into the working chamber 12 via the recessed groove surface 60 with the plug 54 seated on the cover part 16. In one step, the hydraulic accumulator is then filled with the active gas and the working chamber 12 is sealed via the plug 54 by the described friction welding process. With this sealing configuration by the plug 54 a reliable, cheap solution is achieved allowing the user to regard this hydraulic accumulator also as a disposable product, i.e., after one-time use to replace it by a new, comparable hydraulic accumulator and to accordingly dispose of the used one or return it to the manufacturer for recycling or to a maintenance shop.

Figure 2:
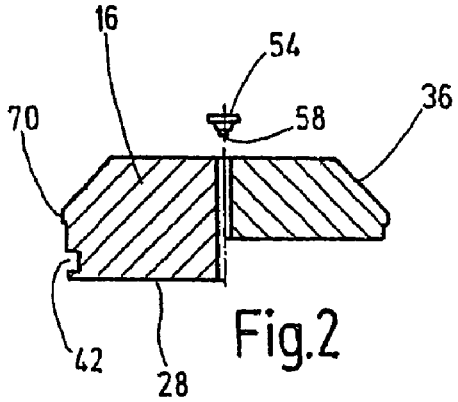
FIG. 2 are partial, side elevational views in section of cover parts of the piston accumulator used in FIG. 1, with a plug to be inserted.

The terminating means shown in FIG. 4 differs from that of FIGS. 1-3 in having a sealing cover 62 with a sealing means 64 in the form of a flat ring seal. The seal is guided on the end side on the inside of the sealing cover 62 on a corresponding offset receiver. This sealing cover 62 can be screwed onto a connecting part 66 penetrated by the through opening 22 and located as a cylindrical extension projecting from and beyond the cover part 16. Preferably, for this configuration includes an engagement screw 68, preferably in the form of an Allen screw, inserted into the through opening 22. In addition to a media-tight termination, for example via an additional sealing element between the screw head and the engagement thread of the engagement screw 68, the terminating means 52 by unscrewing the sealing cover 62 in addition to the engagement screw 68 allows a gas refilling process from the exterior to make the accumulator ready to operate again on site.

In FIG. 2, the cover part 16, 18 has between the engagement groove 42 for the sealing means 44 and the conically tapering fixing bevel 36, an annular contact shoulder 70 projecting in the manner of a step over or beyond the remaining cover part 16, 18 with a small protrusion. This protrusion facilitates the folding-over process for the respective longitudinal edge 34 of the accumulator housing 10 in the manner of a flanging process. The conical surface parts extending toward one another in the form of a fixing bevel 36 with the longitudinal edge 34 and in the form of an articulation 38 form a reliable clamping seat for the respective cover part 16, 18.

With the overall configuration in the region of the respective cover part 16, 18 including the end-side welds 46 and the sealing terminating means 52, the hydraulic accumulator can be economically produced and satisfy the highest requirements with respect to its tightness.

While various embodiments have been chosen to illustrate the invention, it will be understood by those skilled in the art that various changes and modifications can be made therein without departing from the scope of the invention as defined in the appended claims.

What is claimed is:

1. A hydraulic accumulator, comprising:

an accumulator housing having first and second working chambers therein and having first and second longitudinal ends with first and second free longitudinal edges, respectively, said first longitudinal end having a reduced wall thickness relative to a main body portion of said housing between said longitudinal ends forming first articulation and a first stop between different wall thicknesses of said first longitudinal end and said main body portion;

a separator piston movably mounted in said housing and separating said first chamber from said second chamber;

first and second cover parts having inner and outer sides, said first cover part having a conical first fixing bevel on said outer side thereof, said first longitudinal end being bent at said first articulation into a first conical shape over and engaging said first fixing bevel of said first cover part with said first cover part engaging said first stop to fix said first cover part in said housing and to form a fluid-tight sealing of said first working chamber adjacent thereto; and a first peripheral weld connecting said first cover part to said first free longitudinal edge;

whereby, engagement of said first cover part with said conical shape of said first longitudinal end and with said stop forms a clamp seat fixing said first cover part in said housing.

2. A hydraulic accumulator according to claim 1 wherein a first V-shaped fillet groove is formed between an end of said first free longitudinal edge and said first fixing bevel, and holds said weld.

3. A hydraulic accumulator according to claim 2 wherein said weld fills said fillet groove, and projects in transverse cross section therefrom forming a convexly extending surface projecting beyond said first cover part and said end of said first free longitudinal edge.

4. A hydraulic accumulator according to claim 1 wherein said first chamber contains a working gas;

said first cover part seals said first working chamber and includes a through opening therein; and a terminator is received in and seals said through opening gas-tight.

5. A hydraulic accumulator according to claim 4 wherein a connecting part projects from said outer side of said first cover part about said through opening; and a sealing cover with a seal therein is threadedly connected on said connecting part.

6. A hydraulic accumulator according to claim 4 wherein said terminator comprises a plug of ductile material driven into said first cover part and welded to said first cover part.

7. A hydraulic accumulator according to claim 6 wherein said plug comprises a stop head and an insertion part projecting from said stop head and engaging in said through opening, said stop head being larger in transverse diameter than said insertion part; and conically tapering, bridge-shaped groove surfaces are between said stop head and said insertion part, and face said insertion part.

8. A hydraulic accumulator according to claim 1 wherein said inner side of said first cover part engages said first stop with said first cover part inserted in said housing.

9. A hydraulic accumulator according to claim 1 wherein said first cover part has an engagement groove on an outer peripheral surface between said outer and inner sides, and has a gasket in said engagement groove; and said first fixing bevel has an annular contact shoulder projecting as a step from a remaining portion of said first cover part with a small protrusion.

* * * * *